US005480330A

United States Patent [19]

Brown

[11] Patent Number: 5,480,330

[45] Date of Patent: Jan. 2, 1996

[54] MARINE PROPULSION PUMP WITH TWO COUNTER ROTATING IMPELLERS

[75] Inventor: Peter W. Brown, Hartland, Wis.

[73] Assignee: Outboard Marine Corporation, Waukegan, Ill.

[21] Appl. No.: 321,053

[22] Filed: Oct. 4, 1994

[51] Int. Cl.[6] ..... B63H 11/00

[52] U.S. Cl. ..... 440/38; 440/75

[58] Field of Search ..... 440/38, 40, 41, 440/42, 43, 75, 80, 81; 416/128, 129

[56] References Cited

U.S. PATENT DOCUMENTS

| | | | |
|---|---|---|---|
| 132,288 | 10/1872 | Hough . | |
| 2,064,195 | 12/1936 | DeMichelis | 170/165 |
| 2,987,031 | 6/1961 | Odden | 115/37 |
| 3,225,537 | 12/1965 | Parsons | 440/47 |
| 3,906,886 | 9/1975 | Elger . | |
| 3,993,015 | 11/1976 | Klepacz et al. | 440/47 |
| 4,529,387 | 7/1985 | Brandt | 440/66 |
| 4,698,036 | 10/1987 | Brandt | 440/62 |
| 4,795,382 | 1/1989 | McCormick | 440/81 |
| 4,828,518 | 5/1989 | Kouda et al. | 440/50 |
| 4,840,136 | 6/1989 | Brandt | 440/78 |
| 4,887,982 | 12/1989 | Newman et al. | 440/81 |
| 4,897,058 | 1/1990 | McCormick | 440/80 |
| 4,931,026 | 6/1990 | Woodland | 440/38 |
| 4,963,108 | 10/1990 | Koda et al. | 440/81 |
| 5,185,545 | 2/1993 | Veronesi et al. | 310/114 |
| 5,230,644 | 7/1993 | Meisenburg et al. | 440/80 |
| 5,289,068 | 2/1994 | Veronesi et al. | 310/114 |
| 5,310,371 | 5/1994 | Iriono et al. | 440/80 |

FOREIGN PATENT DOCUMENTS

| | | | |
|---|---|---|---|
| 1092098 | 5/1984 | U.S.S.R. | 440/47 |
| 934781 | 8/1963 | United Kingdom | 440/38 |
| 94/008845 | 4/1994 | WIPO | 440/38 |

*Primary Examiner*—Jesus D. Sotelo
*Attorney, Agent, or Firm*—Michael, Best & Friedrich

[57] ABSTRACT

Disclosed herein is a marine propulsion water pump including a casing defining a water passage including an inlet, an outlet, and an intermediate portion between the inlet and the outlet, a first impeller located in the intermediate portion of the casing, a second impeller located in the intermediate portion of the casing and rearwardly of the first impeller, a first shaft drivingly connected to the first impeller, extending forwardly therefrom, and having a hollow interior, a second shaft drivingly connected to the second impeller, extending in the hollow interior of the first shaft and forwardly therefrom, and gearing for counter-rotating the first and second shafts.

7 Claims, 1 Drawing Sheet

MARINE PROPULSION PUMP WITH TWO COUNTER ROTATING IMPELLERS

BACKGROUND OF THE INVENTION

Figure 1:
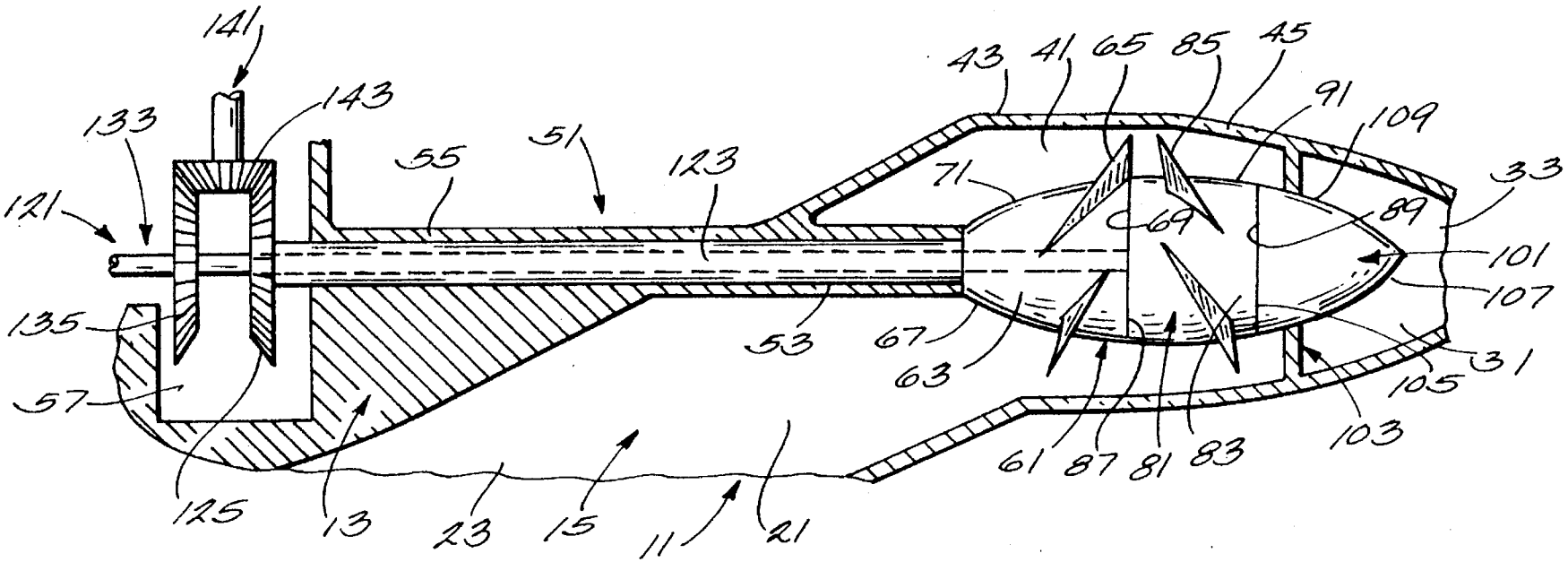

The invention relates generally to marine propulsion water pumps past, such water pumps have included a single impeller and a series of flow-straightening vanes which were fixed in the water passage or tunnel rearwardly of the impeller and which served to straighten the rearwardly directed water flow. However, while these vanes did serve to straighten water flow and to increase flow velocity, the vanes also impeded water flow due to drag induced by water flow therepast.

Attention is directed to the following U. S. Pat. Nos.:

| | | |
|---|---|---|
| J. Hough | 0,132,288 | October 15, 1872 |
| P. De Michelis | 2,064,195 | June 10, 1933 |
| C. R. Odden | 2,987,031 | June 6, 1961 |
| Brandt | 4,529,387 | July 16, 1985 |
| Brandt | 4,698,036 | October 6, 1987 |
| McCormick | 4,795,382 | January 3, 1989 |
| Kouda, et al. | 4,828,518 | May 9, 1989 |
| Brandt | 4,840,136 | June 20, 1989 |
| Newmann, et al. | 4,887,982 | December 19, 1989 |
| McCormick | 4,897,058 | January 30, 1990 |
| Woodland | 4,931,026 | June 5, 1990 |
| Koda, et al. | 4,963,108 | October 16, 1990 |
| Meisenburg, et al. | 5,230,644 | July 27, 1993 |
| Iriono, et al. | 5,310,371 | May 10, 1994 |

SUMMARY OF THE INVENTION

The invention provides a marine propulsion water pump including a casing defining a water passage including an inlet, an outlet, and an intermediate portion between the inlet and the outlet, a first impeller located in the intermediate portion of the casing, a second impeller located in the intermediate portion of the casing and rearwardly of the first impeller, a first shaft drivingly connected to the first impeller, extending forwardly therefrom, and having a hollow interior, a second shaft drivingly connected to the second impeller, extending in the hollow interior of the first shaft and forwardly therefrom, and means for counter-rotating the first and second shafts.

The invention also provides a marine propulsion water pump including a drive housing adapted to be fixed to a boat hull and including a water tunnel having an interior and including an inlet, an outlet, and an intermediate portion between the inlet and the outlet, and an impeller shaft passage extending into the interior of the water tunnel, a first impeller located in the intermediate portion of the water tunnel, a second impeller located in the intermediate portion of the water tunnel rearwardly of the first impeller, a first shaft drivingly connected to the first impeller and having a hollow interior, a second shaft drivingly connected to the second impeller, extending in the hollow interior of the first shaft and forwardly therefrom, and means located forwardly of the impeller shaft passage for counter-rotating the first and second shafts.

Other objects and advantages of the invention will become known by reference to the following general description, to the drawings, and to the claims.

THE DRAWINGS

FIG. 1 is a fragmentary schematic view of a coaxial, counter-rotating impeller arrangement for a marine propulsion water pump, which arrangement includes various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown fragmentarily in the drawings is a marine propulsion water pump 11 which is adapted to be mounted in a boat hull (not shown), which includes a drive housing, casing, or casing member 13 which can be constructed of any suitable material, and which defines a water passage or tunnel 15 including an inlet section or portion 21 having a downwardly open inlet 23 located in a generally horizontal plane, a discharge section or portion 31 which includes a rearwardly open discharge outlet 33 located in a generally vertical plane, and which is in the form of either a rearwardly convergent, or cylindrical nozzle. The water passage or tunnel 15 also includes an intermediate, central, or impeller section or portion 41 which includes a forwardly located generally cylindrical subsection 43 extending rearwardly from the inlet section 21, and a rearwardly located and rearwardly convergent subsection 45 extending rearwardly from the cylindrical subsection 43 and forwardly from the discharge section 31.

Also provided by the casing member 13 is a drive tunnel or impeller drive shaft passage 51 which includes a rearwardly located pipe portion 53 extending horizontally through the inlet section or portion 21 and from the central section or portion 41 and to the upper interior wall or surface of the inlet section 21, and which also includes a second or forward portion 55 extending through the casing member 15 to a gear cavity or space 57 which can also be a part of the casing member 13.

Located in the cylindrical subsection 43 of the casing member 13 is a first or forward impeller 61 including an inner central hub 63 and an angularly spaced series of blades 65 which extend from the central hub 63 to adjacent the inner wall surface of the cylindrical subsection 43. Preferably, the hub 63 has an annular forward end 67 having an outer diameter corresponding to the outer diameter of the rearward end of the pipe portion 53 of the drive tunnel or impeller drive shaft passage 51, an annular rearward end 69, and an outer surface 71 which extends between the forward and rearward ends 67 and 69 and which increases rearwardly in diameter until a maximum diameter at the rearward end 69. Preferably, as seen in forward and rearward profile, the outer surface 71 of the hub 65 is outwardly convex in shape between the forward and rearward ends 67 and 69.

Located in rearwardly adjacent relation to the forward impeller 61, and partially in each of the cylindrical subsection 43 and the conical subsection 45, is a second or rearward impeller 81 including an inner central hub 83 and a plurality of angularly spaced blades 85 which extend from the central hub 83 to adjacent the inner wall surface of the cylindrical and conical subsections 43 and 45.

The hub 83 of the rearward impeller 81 includes a forward end 87 having a diameter corresponding to the diameter of the rearward end 69 of the hub 63 of the forward impeller 61, and a rearward end 89 having a diameter preferably less than the diameter of the forward end 87. Intermediate the forward and rearward ends 87 and 89 thereof, the hub 83 of the rearward impeller 81 includes an outer surface 91 which, in fore and aft profile, is generally outwardly convex in shape.

Also included in the water pump 11 is a rearward hub 101 which can be formed as an integral extension of the hub 83 of the rearward impeller 81, and rotatable therewith, or which can be formed separately from the rearward impeller 81 and suitably located in the discharge section 31 of the casing member 13 by a plurality of angularly spaced vanes 103 which extend between the rearward hub 101 and the inner wall of the discharge section 31 of the water passage or tunnel 15 and which are relatively thin to reduce drag.

The rearward hub 101 has a forward end 105 with a diameter corresponding to the diameter of the rearward end 89 of the hub 83 of the rearward impeller 81, and has a rearward end 107 generally in the form of a point. The rearward hub 101 also includes an outer surface 109 which, in a fore and aft profile, is outwardly convex between the forward end 105 and the point at the rearward end 107.

Thus, there is provided a hub arrangement or profile which has a forward end 67 having a diameter corresponding to the outer diameter of the rearward end of the pipe portion 53 of the drive tunnel or impeller drive shaft passage 51, which has a rearwardly located pointed end, and which, intermediate the forward end and the rearwardly located pointed end 107, includes an outer surface 71, 91, and 109 which increases in diameter from the forward end 67 to a maximum diameter and then decreases to a point at the rearward end 107 along a smooth, outwardly convex, arcuate outline or profile.

The forward and rearward impellers 61 and 81 are suitably driven in opposite rotative directions by a drive train 121 which includes an outer, hollow, forward impeller drive shaft 123 which extends in the drive shaft tunnel or impeller drive shaft passage 51 and which includes a rearward end fixed to the hub 63 of the forward impeller 61 for common rotation therewith, and a forward end extending into the gear cavity or space 57 and fixed to a suitable bevel gear 125 for common rotation therewith.

The drive train 121 also includes an inner, rearward impeller drive shaft 133 which extends in the hollow interior of the outer, forward impeller drive shaft 123 and which includes a rearward end fixed to the hub 83 of the rearward impeller 81 for common rotation therewith, and a forward end extending beyond the bevel gear 125 fixed to the forward end of the outer drive shaft 123, into the gear cavity or space 57, and fixed to a suitable bevel gear 135 for common rotation therewith.

The drive train 121 also includes a generally vertical drive shaft 141 which is adapted to be suitably connected to a driving engine (not shown) and which includes a lower end fixed to a suitable bevel gear 143 for common rotation therewith, which bevel gear 143 is in simultaneous mesh with both of the bevel gears 125 and 135, whereby, incident to rotation of the drive shaft 141, the forward and rearward impellers 61 and 81 are rotated in opposite rotative directions.

Any suitable arrangements can be employed for suitably rotatably supporting the drive shaft 141 and the outer and inner impeller drive shafts 123 and 133 for rotation.

The disclosed construction serves to increase pump performance by reducing or eliminating the drag occurring incident to water flow past the straightening vanes which were provided immediately rearwardly of the single impeller in prior constructions. Furthermore, in the disclosed construction, the rearward water flow is not only straightened, but energy is added thereto by the rearward, counter rotating, second impeller 81.

Various of the features of the invention are set forth in the following claims.

I claim:

1. A marine propulsion water pump including a drive housing adapted to be fixed to a boat hull and including a water tunnel having an interior and including an inlet, an outlet, an intermediate portion between said inlet and said outlet and including a forward cylindrical subsection and a rearward conical subsection, and an impeller shaft passage communicating with said interior of said water tunnel, a first impeller located in said cylindrical subsection in said intermediate portion of said water tunnel, a second impeller located partially in said cylindrical subsection and partially in said conical subsection of said intermediate portion of said water tunnel and rearwardly of said first impeller, a first shaft drivingly connected to said first impeller and having a hollow interior, a second shaft drivingly connected to said second impeller, extending in said hollow interior of said first shaft and forwardly therefrom, and means located forwardly of said impeller shaft passage for counter-rotating said first and second shafts.

2. A marine propulsion water pump in accordance with claim 1 wherein said first impeller includes an inner first hub, wherein said second impeller includes an inner second hub in registry with said first hub, and further including a rearward hub in registry with said second hub and located in said casing.

3. A marine propulsion water pump in accordance with claim 2 wherein said rearward hub is fixed to said casing.

4. A marine propulsion water pump in accordance with claim 2, wherein said rearward hub extends fixedly from said second impeller.

5. A marine propulsion water pump in accordance with claim 2 wherein said first, second, and rearward hubs define a hub arrangement having an outer surface which has an annular forward end with a diameter, a rearward pointed end, and an outer surface which increases in diameter from said forward end and then decreases in diameter toward said pointed rearward end.

6. A marine propulsion water pump in accordance with claim 1 wherein said intermediate portion of said casing includes an interior surface, wherein said first impeller includes a series of blades extending into adjacent relation to said interior surface, and wherein said second impeller includes a series of blades extending into adjacent relation to said interior surface.

7. A marine propulsion water pump including a casing defining a water passage including an inlet, an outlet, and an intermediate portion between said inlet and said outlet and including a forward cylindrical subsection and a rearward conical subsection, a first impeller located in said cylindrical subsection in said intermediate portion of said casing and including a first inner hub, a second impeller located partially in said cylindrical subsection and partially in said conical subsection in said intermediate portion of said casing and rearwardly of said first impeller and including a second inner hub in registry with said first inner hub, a rearward hub located in said casing and in registry with said second hub, a first shaft drivingly connected to said first impeller, extending forwardly therefrom, and having a hollow interior, a second shaft drivingly connected to said second impeller, extending in said hollow interior of said first shaft and forwardly therefrom, and means for counter-rotating said first and second shafts.

* * * * *